United States Patent [19]

Hatanaka et al.

[11] 4,094,105

[45] June 13, 1978

[54] CAM GRINDING MACHINE WITH WORKPIECE SPEED CONTROL

[75] Inventors: Shiro Hatanaka, Toyota; Tsuyoshi Tamesui, Okazaki; Tsuneharu Matsuura, Kariya, all of Japan

[73] Assignees: Toyoda-Koki Kabushiki-Kaisha; Toyota Jidosha Kogyo Kabushiki Kaisha, both of Japan

[21] Appl. No.: 804,596

[22] Filed: Jun. 8, 1977

[30] Foreign Application Priority Data

Jun. 18, 1976 Japan ..... 51-72563

[51] Int. Cl.[2] ..... B24B 17/00; B24B 5/42

[52] U.S. Cl. ..... 51/101 R; 51/105 EC; 51/165.9

[58] Field of Search ..... 51/101 R, 97 R, 97 NC, 51/327, 165.8, 165.9, 165.92, 165.77, 105 EC, 105 SP

[56] References Cited

U.S. PATENT DOCUMENTS 2,786,311 3/1957 Hill ..... 51/101 R 3,683,558 8/1972 Oishi ..... 51/101 R 3,797,176 3/1974 Wespi ..... 51/101 R

*Primary Examiner*—N. P. Godici

*Attorney, Agent, or Firm*—Oblon, Fisher, Spivak, McClelland & Maier

[57] ABSTRACT

A cam grinding machine is provided wherein a wheel head is fed toward a rocking table carrying a work spindle so as to grind a cam roughly in a first step and finely in a second step successive thereto, and a speed-switchable motor is operated in such a way as to drive the work spindle and the rocking table at a fast speed in the first step and at a slow speed in the second step. The grinding machine is further provided with a motor control circuit which is arranged to switch the motor from the fast speed to the slow speed, with a delay of time that is required for the cam to rotate at least one revolution after the switching of the grinding step from the first step to the second one, so that an excessive infeed caused by the spring-back action of the cam can be reduced.

7 Claims, 6 Drawing Figures

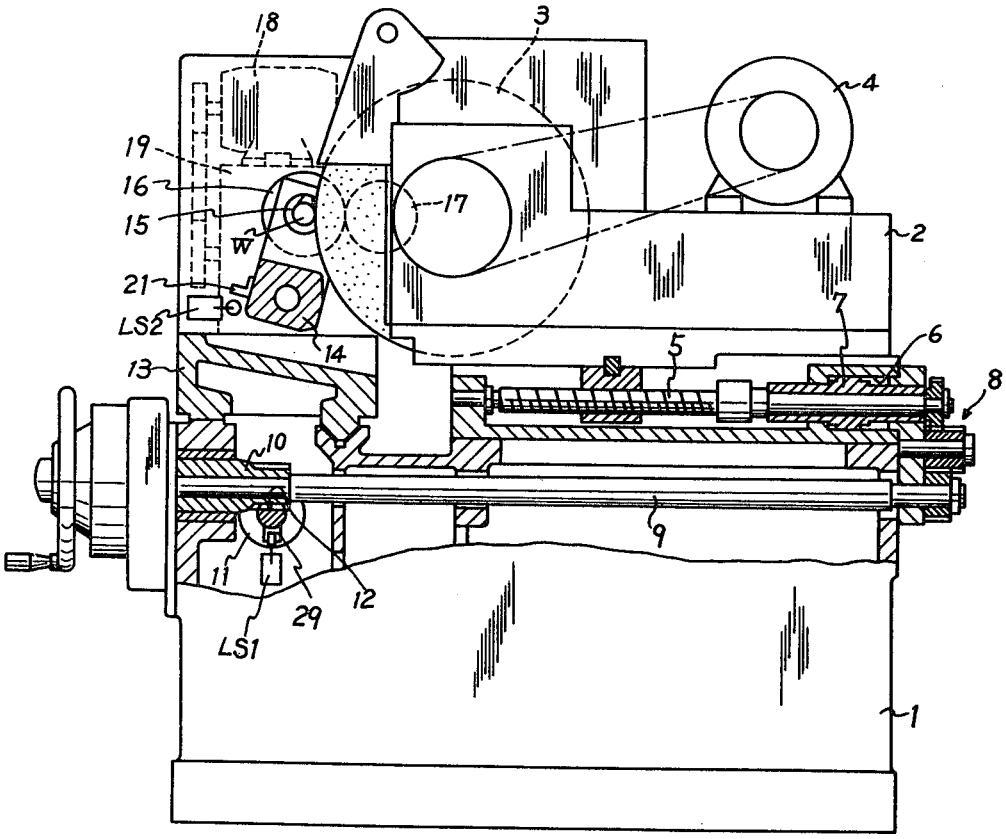

CAM GRINDING MACHINE WITH WORKPIECE SPEED CONTROL

BACKGROUND OF THE INVENTION

1. Field of the Invention

The present invention relates generally to grinding machines, and more particularly to a cam grinding machine for grinding automotive cams and the like.

2. Description of the Prior Art

In conventional cam grinding machines for grinding a cam supported on a work spindle with a grinding wheel while rocking the work spindle on the traces of the profile of a master cam, the rotational speed of the work spindle is reduced at the same time as the infeed movement of the grinding wheel is stopped, in order to finely finish the ground surface of the cam. Such rotational control of the work spindle, however, causes the cam to return to its ideal rotational axis as quickly as a spring, and thus, a part of the cam, which was to be ground during the last rotation before the speed reduction, but is left unground, is subsequently ground in the condition of the work spindle being rotated at the slow speed, whereby cracks are created upon this part of the cam because it receives heating and cooling for an extremely short period of time due to the fact that the decrease of the relative circumferential speed between the cam and the grinding wheel lowers the metal removing ability of the grinding wheel. Especially, it is a serious problem that cracks and the heat-affected surface layer created upon the top or sloping-up profile portion of the cam are left unremoved, irrespective of the performance of the fine grinding operation.

SUMMARY OF THE INVENTION

It is therefore an object of the present invention to provide an improved cam grinding machine being capable of grinding cams with high accuracy.

Another object of the present invention is to provide an improved cam grinding machine in which the rotational speed of a work spindle is reduced after a cam being ground returns to its ideal rotational axis, so as to prevent the creation of cracks and a heat-affected surface layer upon the cam.

A further object of the invention is to provide an improved cam grinding machine having a motor control circuit for switching the rotational speed of a work spindle from a fast speed to a slow speed when the same is rotated at least one revolution after the switching of the grinding operation from a first step to a second step is completed.

Briefly, according to this invention, there is provided a cam grinding machine, which comprises a wheel head with a grinding wheel, a rocking table being pivotable toward and away from the wheel head, a work support mounted upon the rocking table and including a rotatable work spindle for supporting a cam to be ground, a work drive device provided for imparting rotational and rocking movements, respectively, to the work spindle and the rocking table and being operable selectively at fast and slow drive speeds, a feed device for infeeding one of the wheel head and the rocking table toward the other so as to grind the cam roughly at a first step and thereafter finely at a second step, and a control circuit for controlling the work drive device.

The control circuit includes a detector for generating a switch signal when the operation of the one of the wheel head and the rocking table is switched from the first step to the second one, and a delay circuit responsive to the switch signal for generating a speed-down signal when the work spindle is rotated at least one revolution after receiving the switch signal. The control circuit further includes a switch circuit which, upon receipt of the speed-down signal, switches the rotational speed of the work drive device from the fast drive speed to the slow speed, so that an excessive infeed of the grinding wheel, relative to the cam, can be prevented when the rotational speed of the work spindle is reduced.

BRIEF DESCRIPTION OF THE DRAWINGS

Various other objects, features and attendant advantages of the present invention will be more fully appreciated as the same becomes better understood from the following detailed description of the preferred embodiments when considered in connection with the accompanying drawings, wherein like reference numerals designate like or corresponding parts throughout the several views, and in which.

DETAILED DESCRIPTION OF THE PREFERRED EMBODIMENTS

Figure 1:
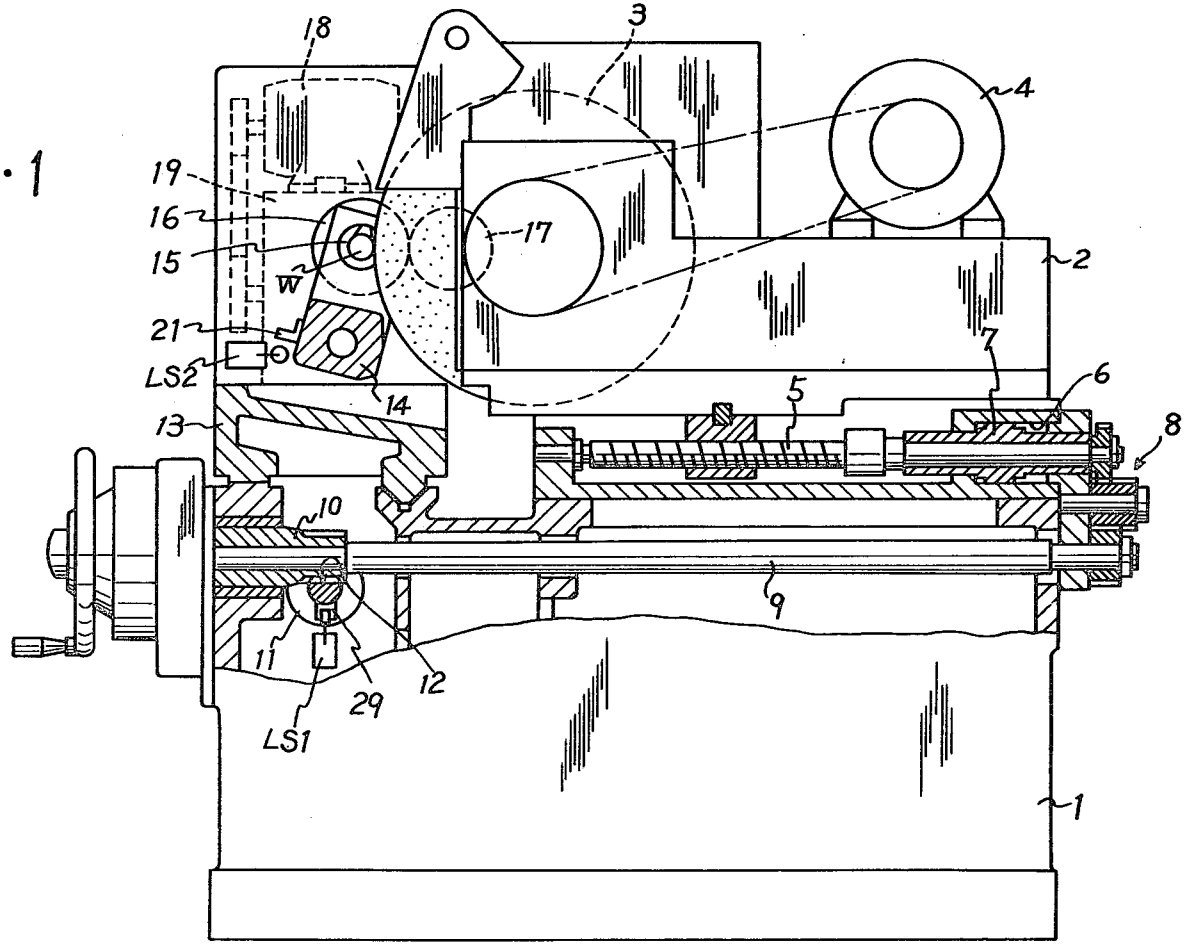
FIG. 1 is a side elevational view, partly in section, of a cam grinding machine according to the present invention.

Referring now to the drawings and more particularly to FIGS. 1 to 4, where a first preferred embodiment of a cam grinding machine is illustrated, there is shown a bed 1, on which is slidably mounted a wheel head 2, rotatably carrying a grinding wheel 3, which is drivingly connected through driving belts with a wheel drive motor 4 so as to be driven thereby. The wheel head 2 is threadedly engaged with a feed screw 5, which is supported by a piston 7 to be movable only in the rotational direction, the piston 7 being fitted into a rapid feed cylinder 6 through the rear end of which the piston 7 extends to be drivingly connected with a drive shaft 9 through a gear train generally indicated at 8. The drive shaft 9 has rotatably supported thereon a gear sleeve 10, which is connectable with the drive shaft 9 by a clutch mechanism, not shown, and to which is geared a rack 12 capable of being reciprocated by a grinding feed cylinder 11.

Upon the bed 1, there is mounted a work table 13, upon which a rocking table 14 is in turn mounted to be pivotable about a pivot axis extending perpendicularly of the direction that the wheel head 2 is slidable in. A work spindle 15 is rotatably mounted on the rocking table. The rocking table 14 is urged by means of a spring, not shown, to be pivotably moved in the clockwise direction, as viewed in FIG. 1, so that a master cam 16, keyed upon the work spindle 15, is maintained in contact with a cam follower 17, which is freely rotatably supported upon the work table 13. Furthermore, indicated at 18 is a pole change motor, which is fixed upon a reduction gear box 19 mounted upon the table 13, and an output shaft of the motor 18 is drivingly connected with the work spindle 15 through a pulley-belt driving mechanism, a worm and worm wheel mechanism, and a universal joint, the further details of which, however, are omitted as being well-known and obvious to those skilled in the art.

Figure 4:
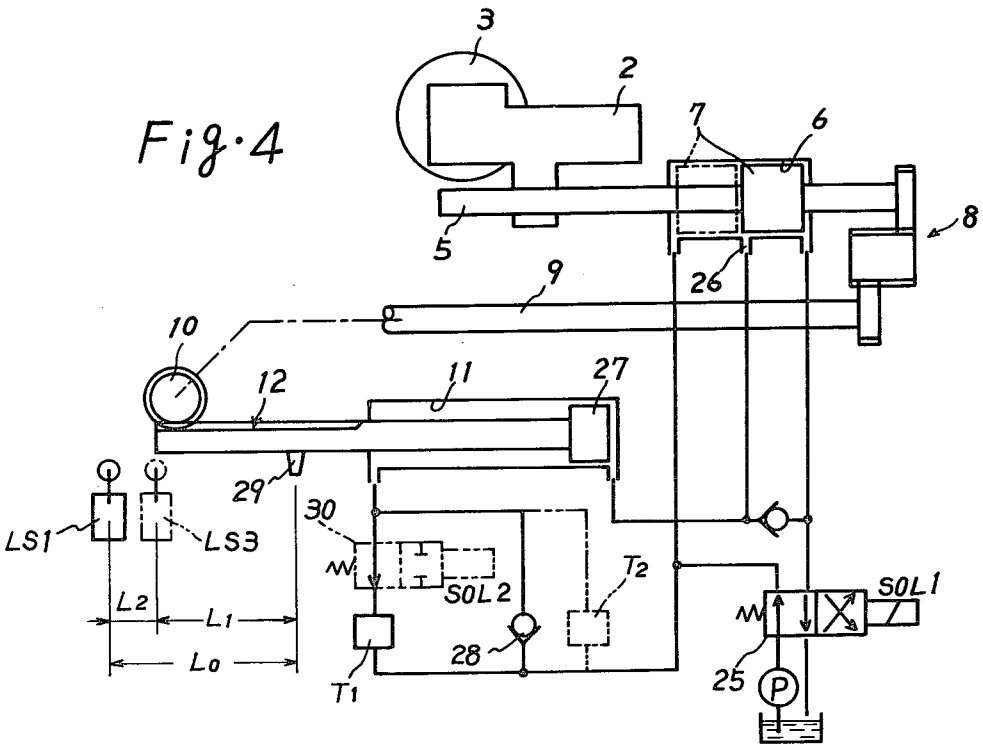
FIG. 4 shows a hydraulic control circuit of the apparatus.

FIG. 4 illustrates a hydraulic control circuit of the apparatus, wherein a change-over valve 25, with a solenoid SOL 1, is connected to supply and exhaust fluid under pressure to and from the rapid feed cylinder 6 and the grinding feed cylinder 11. An intermediate port 26 is arranged in the rapid feed cylinder 6 to open and communicate with the rear chamber of the grinding feed cylinder 11 only when the piston 7 reaches its advanced end, so that, at that time, the piston 27 of the grinding feed cylinder 11 and the rack 12 are able to advance at a grinding feed rate as a parallel circuit of a variable throttle T1 and a check valve 28 is connected between the forward chamber of the grinding feed cylinder 11 and the change-over valve 25. A reference character LS1 denotes a limit switch, which is disposed to be activated by a dog 29 at the time of the piston 27 reaching its advanced end. Illustrated by the phantom line are another, or second, variable throttle T2, a change-over shut-off valve 30, and a limit switch LS3, which are provided for a second preferred embodiment, as will hereinbelow be described in detail, and therefore, are not to be taken into consideration in this first embodiment.

Figure 2:
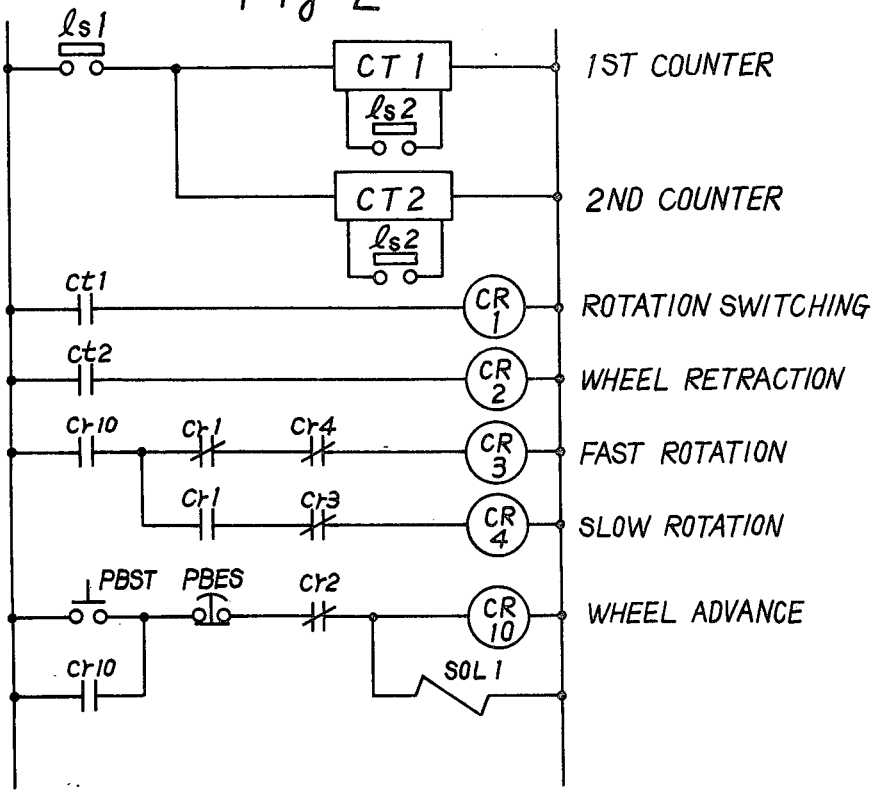
FIG. 2 is a ladder diagram illustrative of an electric control circuit of the apparatus.

FIG. 2 shows an electric control circuit of the apparatus, referring to which the operation of the apparatus, constructed as above, will be described hereinbelow. When a start push button switch PBST is depressed, after the loading of a cam W to be ground onto the work spindle 15, a magnetic relay CR10 is energized, together with the solenoid SOL1, through a normally closed emergency stop button switch PBES and a normally closed contact cr2, and is self-held through a normally open contact cr 10 thereof. Thus, the change-over valve 25 is switched to supply fluid under pressure into the rear chamber of the rapid feed cylinder 6, whose piston 7 is advanced together with the wheel head 2 toward the cam W at a rapid feed rate. With the energization of the relay CR10, a magnetic relay CR3 is energized through normally closed contacts cr1 and cr4, so that the work drive motor 18 is rotated in such a condition as to have four-poles thereof being energized, driving the work spindle 15 together with the cam W at a fast rotational speed. The rotation of the work spindle 15 causes the rocking table 14 to be rocked to and from the wheel head 2 on the traces of the cam profile of the master cam 16 because the master cam is maintained in contact with the cam follower 17 and, as a result, a cam generating motion for profiling a desired shape on the cam W is given between the grinding wheel 3 and the cam W.

Upon arrival of the piston 7 at its advanced end, the intermediate port 26 is opened to conduct fluid under pressure into the rear chamber of the grinding feed cylinder 11, whose piston 27 is therefore advanced to rotate the feed screw 5 through the rack-pinion mechanism 12, 10, the drive shaft 9, and the gear train 8, whereby the wheel head 2 is fed at a grinding feed rate depending upon the variable throttle T1, the grinding wheel 3 starting grinding of the cam W (first grinding step).

Figure 3:
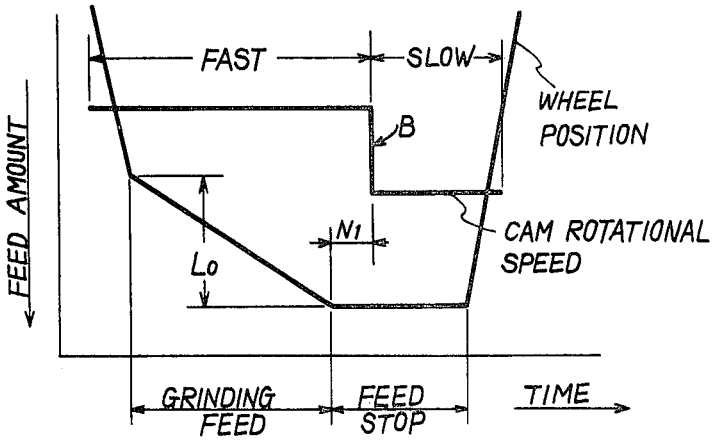
FIG. 3 is an operational cycle chart showing a relationship between the grinding wheel movement and the work spindle rotation.

When the piston 27 reaches its advanced end after moving a stroke Lo, the grinding infeed of the wheel head 2, namely the first grinding step is completed, as indicated in FIG. 3, from the time of which is initiated a second grinding step wherein the grinding wheel 3 is maintained in contact with the cam W because of the spring-back action thereof although not being infed any more, and simultaneously, the limit switch LS1 is activated by the dog 29 to make first and second counters CT1 and CT2 operative. These counters CT1 and CT2 are connected at their input terminals, respectively, with normally open contacts *ls*2 of a limit switch LS2, which is disposed to be operated by a dog 21 each time the rocking table 14 is moved to its rocking end in the counter-clockwise direction in FIG. 1, or in other words, each time a top portion of the cam W comes into contact with the grinding wheel 3, and respectively have set values N1 and N2 ($N1 < N2$, $N1$ = an integer $\geqq 1$) preset thereinto. Accordingly when the limit switch LS2 is operated through N1-times, for example, two times after the completion of the first grinding step, the first counter CT1 is counted up to close its normally open contact ct1, so as to thereby energize a magnetic relay CR1. This relay CR1, when energized, opens its normally closed contact cr1 to deenergize the relay CR3 and closes its normally open contact *cr*1, to energize a magnetic relay CR4 through a normally closed contact cr3 of the relay CR3 now being deenergized, whereby the rotation of the work spindle 15 and the rocking movement of the rocking table 14 is changed from the fast speed to a slow speed, as indicated at B in FIG. 3, since the motor 18 is switched from four-pole drive to six-pole drive.

In this manner, the rotation of the cam W is maintained at the fast speed during the time it rotates two revolutions after the grinding infeed of the wheel head 2 is stopped, and thus, when the cam W goes back toward the wheel head 2, due to its spring-back action resulting from the stopping of the wheel head 2, a part of the cam W, which was left unground, is exactly removed with the grinding wheel 3 in a pertinent grinding condition within such two revolutions.

When the cam W is rotated through N2, or for example, five revolutions, after the completion of the first griding step, the second counter CT2 is counted up to close its normally open contact ct2, and, when energized therefore, a magnetic relay CR2 opens its normally closed contact cr2 to deenergize the relay CR10 and the solenoid SOL1. At being switched to its initial position, the change-over valve 25 supplies fluid under pressure into the forward chamber of the cylinder 11 through the check valve 28 and the forward chamber of the cylinder 6 to rapidly retract pistons 27, 7 of the cylinders 11, 6, so that the wheel head 2 returns to its retracted end. The relay CR4 is deenergized as the contact *cr*10 is opened with the deenergization of the relay CR10, and the motor 18 is stopped, resulting in terminating the rotation of the work spindle 15 and the rocking movement of the rocking table 14, and consequently, one cycle of the grinding operation is completed. In this manner, the cam W is ground without the infeed movement of the grinding wheel 3 during the time it rotates three revolutions at the slow speed after the removal of the unground part, and can therefore be considerably enhanced in accuracies of the surface finish and the profile.

Figure 5:
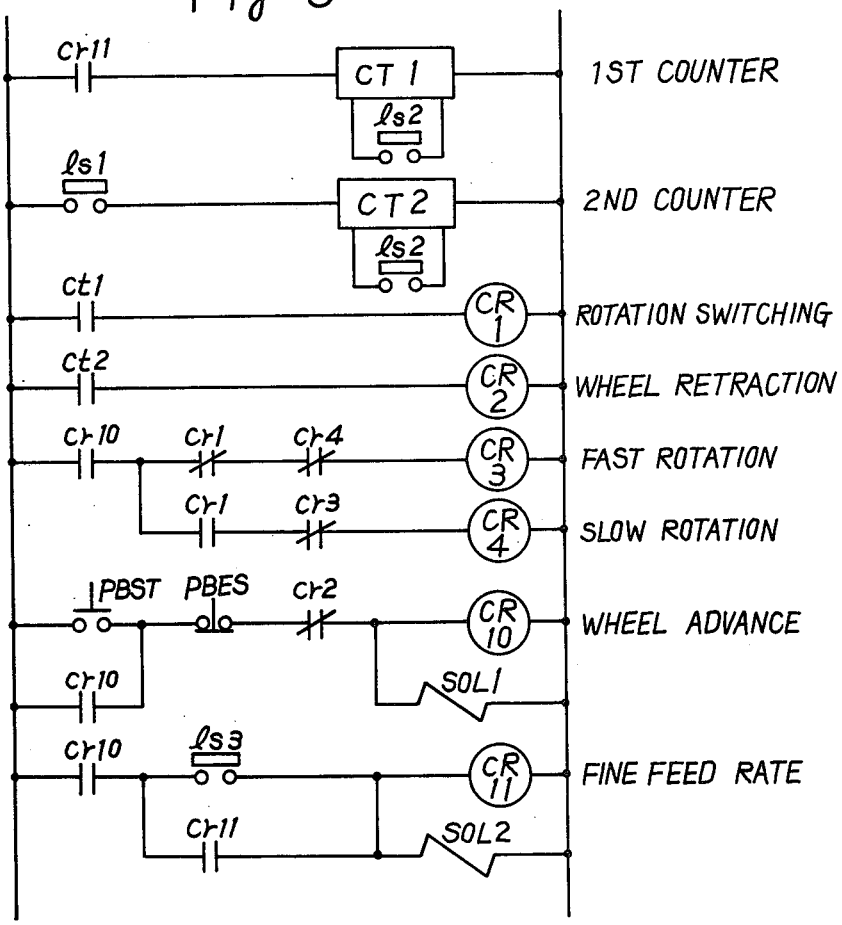
FIG. 5 is a ladder diagram illustrative of another or second embodiment of the electric control circuit.
Figure 6:
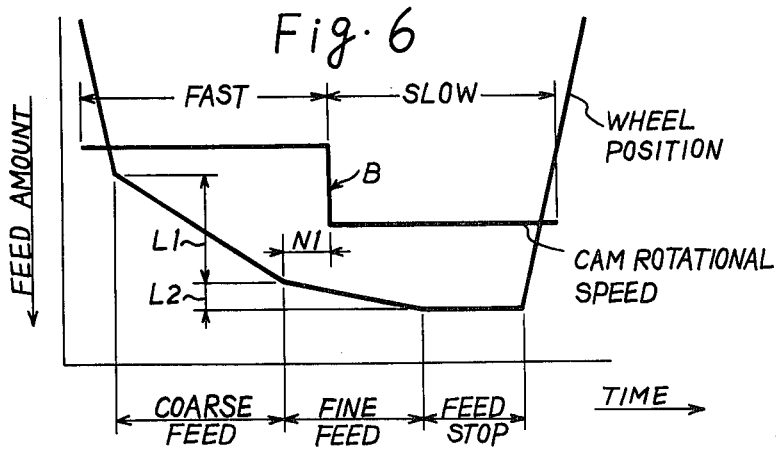
FIG. 6 is an operational cycle chart showing, however, a relationship in the second embodiment between the grinding wheel movement and the work spindle rotation.

FIGS. 5 and 6 show an electric control circuit and an operational cycle chart in a second preferred embodiment of the present invention. In this embodiment, as mentioned previously, some modifications are made in the hydraulic control circuit. Referring to FIG. 4, a change-over shut-off valve 30 is connected in series with the throttle T1, and a second variable throttle T2 with a throttle resistance larger than that of the throttle T1 is connected in parallel with the shut-off valve 30, throttle T1, and the check 28. Furthermore, a limit switch LS3 is disposed to divide the stroke Lo into first and second strokes L1 and L2, respectively, defining first and second grinding steps in this particular embodiment. As viewed in FIG. 5, a magnetic relay CR11 and a solenoid SOL 2 of the shut-off valve 30 are connected to be energized through a normally open contact cr10 of the relay CR10 and a normally open contact *ls*3 of the limit switch LS3, being self-held through a normally open contact cr11. When the activation of the limit switch LS3, by means of the dog 29, allows the relay CR11 and the solenoid SOL2 to be energized, the shut-off valve 30 is shut, resulting in terminating a coarse grinding operation (first grinding step), whose feed rate depends on the throttle T1, and then, in initiating a fine grinding operation (second grinding step) wherein, unlike the first embodiment, the wheel head 2 is further fed at a fine feed rate, depending on the second throttle T2, as readily understood from FIG. 6. The first counter CT1, connected with a normally open contact cr11 in this particular embodiment, is made active with the energization of the relay CR11 and, when counted up, closes its contact ct1. Because the counter CT1 has the number "2" preset therewithin, as mentioned previously, the rotational speed of the work spindle 15 and the rocking movement of the rocking table 14 are switched from the fast speed to the slow speed when the revolutions of the cam W are effected after the switching from the coarse feed rate to the fine feed rate, as indicated in FIG. 6. Preferably, the second counter CT2 in this embodiment may be adjusted to have another preset value, for example "3".

Although, in the embodiments, the counter CT1 is used to count the rotational number of the cam W, it is to be noted that the present invention is not limited thereto. In the case that a timer is provided to be energized on arrival of the wheel head 2 at its advanced end or at its coarse grinding feed end, and that a preset time of the timer is adjusted to be the time that is required for the cam W to rotate through one or a few revolutions, switching of the rotational speed of the cam W from the fast speed to the slow speed is achieved in response to a time-up signal supplied from the timer.

As aforementioned in detail, the present invention provides a cam grinding machine, wherein the rotational speed of the cam being ground is switched from a fast speed to a slow speed, with a delay of time that is required for the cam to rotate at least one revolution after the grinding step is switched from the first step to the second step. According to the present invention, therefore, the part of the cam unground in the first grinding step can be exactly removed during the time the rotational speed of the work spindle still remains at the fast speed in the second grinding step and, consequently, the creation of a heat-affected surface layer and cracks upon the cam can be perfectly prevented. Furthermore, as the cam is subsequently ground in such a condition as to be rotated at the slow speed in the second grinding step, the surface finish accuracy and the profile accuracy of the cam can also be enhanced.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. In a cam grinding machine having a wheel head for rotatably carrying a grinding wheel, a rocking table being pivotable toward and away from said wheel head, a work support mounted upon said rocking table and provided with a rotatable work spindle for supporting a cam to be ground, a work drive mechanism including a master cam and a cam follower for imparting rotational and rocking movements, synchronized with each other, respectively, to said work spindle and said rocking table, so as to generate a predetermined contour on said cam, a speed-switchable drive motor for driving said work drive mechanism selectively at fast and slow speeds, and feed means for infeeding one of said wheel head and said rocking table toward the other to cause said grinding wheel to grind said cam roughly in a first grinding step and thereafter finely in a second grinding step, the improvement of which comprises:

detecting means for generating a switch signal when the infeed movement of said one of said wheel head and said rocking table is switched from said first grinding step to said second grinding step;

delay means responsive to said switch signal for generating a speed-down signal when said work spindle is rotated at least one revolution after receiving said switch signal; and a motor control circuit connected with said drive motor and said delay means for controlling said drive motor to switch the operational speed of said work drive mechanism from said fast speed to said slow speed in response to said speed-down signal.

2. A cam grinding machine as set forth in claim 1, wherein said delay means comprise a counter for counting the rotational number of said work spindle after receiving said switch signal and for generating said speed-down signal when the counted rotational number coincides with a predetermined value preset thereto, which is an integer not less than one.

3. A cam grinding machine as set forth in claim 2, wherein said delay means further comprises switch means connected with said counter for supplying a count input signal to said counter each time a top portion of said cam comes into contact with said grinding wheel, so as to thereby make said counter count said rotational number based upon said count input signal.

4. A cam grinding machine as set forth in claim 3, wherein said feed means is arranged to feed said one of said wheel head and said rocking table at a predetermined grinding feed rate in said first grinding step and to maintain said one of said wheel head and said rocking table at the fed end in said second grinding step.

5. A cam grinding machine as set forth in claim 4, wherein said speed-switchable drive motor is a pole change motor.

6. A cam grinding machine as set forth in claim 3, wherein said feed means is arranged to feed said one of said wheel head and said rocking table at a coarse grinding feed rate in said first grinding step and at a fine grinding feed rate in said second grinding step.

7. A cam grinding machine as set forth in claim 6, wherein said speed-switchable drive motor is a pole change motor.

* * * * *